US005125962A

United States Patent [19]

Krentscher

[11] Patent Number: 5,125,962

[45] Date of Patent: Jun. 30, 1992

[54] COPPER-BASED SINTERED MATERIAL, ITS USE, AND METHOD OF PRODUCING MOLDED PARTS FROM THE SINTERED MATERIAL

[75] Inventor: Bernd Krentscher, Radevormwald, Fed. Rep. of Germany

[73] Assignee: Sintermetallwerk Krebsöge GmbH, Radevormwald, Fed. Rep. of Germany

[21] Appl. No.: 434,465

[22] Filed: Nov. 13, 1989

[30] Foreign Application Priority Data

Nov. 12, 1988 [DE] Fed. Rep. of Germany ..... 3838461

[51] Int. Cl.[5] ..... B22F 3/12; C22C 9/00

[52] U.S. Cl. ..... 75/247; 419/36; 419/37; 419/38; 419/57

[58] Field of Search ..... 75/228, 247; 419/38, 419/57, 23, 36, 37

[56] References Cited

U.S. PATENT DOCUMENTS

| | | | |
|---|---|---|---|
| 2,849,789 | 9/1958 | Thomson | 75/247 |
| 2,887,765 | 5/1959 | Thomson et al. | 75/247 |
| 3,790,351 | 2/1974 | Niimi et al . | 75/247 |
| 4,000,981 | 1/1977 | Sugafuji et al. | 75/247 |
| 4,083,719 | 4/1978 | Arakawa et al. | 75/247 |
| 4,299,629 | 11/1981 | Haack | 75/251 |
| 4,919,717 | 4/1990 | Ambier et al. | 75/247 |
| 4,935,056 | 6/1990 | Miyasaka | 75/247 |
| 4,941,919 | 7/1990 | Asada et al. | 75/247 |

FOREIGN PATENT DOCUMENTS

| | | |
|---|---|---|
| 56-04618 | 11/1975 | Japan . |
| 5435577 | 12/1975 | Japan . |
| 58-81942 | 5/1983 | Japan . |
| 58-151443 | 9/1983 | Japan . |
| 2024258 | 1/1980 | United Kingdom . |
| 2045806 | 11/1980 | United Kingdom . |
| 2067221 | 7/1981 | United Kingdom . |

OTHER PUBLICATIONS

Patent Abstracts of Japan, Pub. #61064838, "High Density Copper Sintered Alloy", Aug. 9, 1986.

Derwent Publications Ltd., 79-87077B (48) "Copper Based Sintered Alloy for Valve Seat", Dec. 11, 1975.

*Primary Examiner*—Brooks H. Hunt

*Assistant Examiner*—Daniel J. Jenkins

*Attorney, Agent, or Firm*—Spencer, Frank & Schneider

[57] ABSTRACT

A sintered material resistant to heat and mechanical strain, particularly to impact and friction, for the production of molded articles, made of a matrix metal powder having approximately 70 to 100% by weight of a copper component and approximately 0 to 30% by weight of an alloy component of cobalt, chromium, iron, manganese, nickel, tungsten and/or carbon. In another embodiment, the sintered material may also include an additional high-alloy metal powder admixed as a hard phase to the matrix metal powder. The additional high-alloy metal powder is present in the amount of a maximum 30% by weight, with respect to the sum of the matrix metal powder and high-alloy metal powder. The sintered material is especially suitable for heat- and wear-resistant molded articles for use in high gas environments, for example, in internal combustion engines. For example, guides, bearings, and valve elements may be made of this material and especially valve seat rings.

32 Claims, 2 Drawing Sheets

COPPER-BASED SINTERED MATERIAL, ITS USE, AND METHOD OF PRODUCING MOLDED PARTS FROM THE SINTERED MATERIAL

REFERENCE TO RELATED APPLICATIONS

This application claims the priority of Federal Republic of Germany application Ser. No. P 38 38 461.2 filed Nov. 12th, 1988, which is incorporated herein by reference.

FIELD OF THE INVENTION

The invention relates to sintered material, produced from a matrix metal powder, that is resistant to heat and mechanical strain, and in particular impact and friction, for manufacturing molded articles. The invention also relates to the use of the aforementioned sintered material as well as to a method for producing molded articles from the sintered material.

From a sintered material of this kind, molded articles are made for instance for parts of machines that are exposed to hot gases or gas mixtures, such as combustion gases. This is applicable to parts of piston engines, such as valve seat rings.

BACKGROUND OF THE INVENTION

German Patent 21 14 160 discloses a sintered material that is made of an iron-based material to which carbon and lead as well as other alloy ingredients are added. This sintered material is said to have increased thermal conductivity compared with previously known materials. Thermal resistance and erosion resistance of the valve seat rings made from the sintered material are also said to be increased. However, relatively low limits are placed on the increase in thermal conductivity and in erosion strength, because the matrix material is an iron-based material.

A valve seat ring for a reciprocating piston internal combustion engine is disclosed in German Patent Disclosure Document DE-OS 35 28 526. There the valve seat is formed of two rings, of which the inner valve ring, disposed on the seat face of the valve, comprises a heat-resistant material of great hardness not made by powder metallurgy, while the outer ring in the seat comprises a material that has good thermal conductivity and is likewise not made by powder metallurgy. However, it should be noted that the greatest heat arises in the vicinity of the seat face of the valve and hence of the inner valve ring. From there it is supposed to be dissipated first through the inner valve ring and then through the outer seat ring. The thermally resistant material provided for the inner valve ring, having great hardness, is only slightly suited for this purpose, because it has merely conventional thermal conductivity.

SUMMARY OF THE INVENTION

The object of the invention is to devise a sintered material the resistance of which to heat and mechanical strain, such as impact and friction, is substantially greater than that of known sintered material. It is the particular object of the invention to devise a sintered material that is suitable for manufacturing valve seat rings. A method for producing heat-resistant and wear-resistant molded articles, in particular valve seat rings, using the sintered material is also to be devised.

This object is attained in accordance with the present invention by a sintered material having a matrix metal powder comprised of a copper component of approximately 70 to 100% by weight copper and an alloy component of approximately 0 to 30% by weight of cobalt, chromium, iron, manganese, nickel, tungsten, and carbon. This sintered material, like known sintered materials, additionally has the contaminants dictated by the production process.

DETAILED DESCRIPTION OF THE PREFERRED EMBODIMENT

The sintered material according to the present invention has a thermal conductivity that is several times higher than iron-based sintered materials. As a result, in the presence of mechanical strain such as impact and/or friction, at elevated temperatures, heat can be dissipated substantially better. With applicable temperatures and gases or gas mixtures, such as combustion gases, oxides are produced, which result in a lubricating action. From this effect arises the resistance of the sintered material to mechanical strain, for instance in direct metal-to-metal contact without the addition of a lubricant. One or more oxides form a lubricating film, which reliably prevents brief and locally limited wear of the sintered material in direct contact with some other metal material. The sintered material according to the present invention thus has the property of self-lubrication that is spontaneously renewed at any time.

This effect is attained on the one hand by means of the copper-based material, which compared with other metal materials not only has a very high thermal conductivity but also forms oxides with sufficient separating and lubricating action. One or more alloy components that likewise form oxides in heat constitute a further factor. The thermal conditions may, in accordance with a particular feature of the present invention, correspond to those that prevail in the combustion chambers of combustion engines, in particular internal combustion engines. The sintered material according to the present invention under these conditions has a particularly low coefficient of friction. Although this sintered material is relatively soft, it has considerable wear resistance because of its other properties. As a result it can resist greater mechanical strains at higher temperatures for longer than known iron-based sintered materials, which have greater hardness.

In preferred embodiment of the present invention the copper component accounts for 95 to 100%, by weight, and the alloy component accounts for 5 to 0% by weight of the sintered material. Preferably, the component of metal alloy elements according to the present invention comprises from 1 to 3% by weight of cobalt. The component of production process-dictated contaminants can, according to the invention, amount to a maximum of 0.5% by weight. The powder constituent of the sintered material maximum particle size may be approximately 150 μm and the mean particle size approximately 45 to 60 μm.

According to another embodiment of the present invention, a high-alloy metal powder additive is admixed to the matrix metal powder as a hard phase, the hard phase component amounting to a maximum of 30% by weight. The term high-alloy metal powder refers generally to hard facing alloys, and specific examples of such powder are stellites. For the sake of economy, however, the proportion of the hard phase component may be reduced so that it amounts to 10% by weight at most. The proportion of the hard phase of either 30 or 10% by weight, maximum, is relative to the sum of the matrix metal powder and the added high-alloy metal powder. From this it follows that the copper component and the alloy component in the matrix metal powder make up correspondingly smaller proportion than the sum of matrix metal powder and added high-alloy metal powder. If powder metallurgy processes are used in accordance with the invention, then structures can be produced thereby in which more or less finely distributed wear-reducing structural constituents are embedded in a highly thermally conductive matrix.

In an embodiment of the present invention, the composition of the hard phase in percent by weight is: chromium, 24 to 28%; nickel, 21 to 25%; tungsten, 10 to 14%; carbon, 1.5 to 2.0%; and the remainder being cobalt. In another embodiment, the hard phase may also have the following composition: chromium, 20 to 32%, tungsten, 5 to 10%, carbon, 0.3 to 2.5%, the remainder cobalt. In both of the above compositions of the hard phase, the matrix metal powder may be a pure, unalloyed copper powder. In that case, the matrix has cobalt alloyed to it during the sintering by diffusion.

In another embodiment of the present invention, the composition of the hard phase is, again in percentage by weight: chromium, 23 to 27%; nickel, 8 to 12%; manganese, 8 to 12%; carbon, 0.4 to 0.6%; and the remainder iron.

The sintered material as such and its various embodiments may according to the invention be used for producing heat- and/or wear-resistant molded articles that are exposed to hot gases or gas mixtures, such as combustion gases. The sintered material may be used for seal, guide, bearing or valve elements. These are used as parts of machines, such as piston engines and their supplementary equipment. The use in turbochargers or exhaust systems and exhaust gas recirculation systems is also possible.

In a preferred aspect of the invention, the sintered material may be used for producing valve seats for internal combustion engines, particularly valve seat rings for combustion engines. Valve seat rings produced from the sintered material or from its various embodiments are well capable of dissipating the heat developed from combustion. This offers the possibility of performing the combustion at higher temperatures than previously possible. This increases the efficiency of a combustion engine.

The heat is dissipated from the outermost, hot seat face of the valve via the valve seat ring. As a result it is possible to produce the valve from a material that is less heat-resistant and hence is more economical than previously known valves. Alternatively, when using known materials it is possible to employ higher combustion temperatures for the valve, without damaging the valve.

The oxides of the sintered material according to the present invention produce the separating and lubricating action referred to above. This keeps the wear to a low level. By comparison, known valve seat rings are made from a material having great hardness, to reduce wear. For known valves not to undergo excessive wear in the contact surface, the known hard valve seat ring is paired with a valve that is extensively clad with a very hard protective layer in the vicinity of the known valve seat. Known heat-resistant materials of high hardness have low heat conductivity and represent a barrier to the flow of heat from the valve to the valve seat ring.

This disadvantage is overcome by a valve seat ring according to the present invention. Although the sintered material according to the invention is relatively soft, the wear resistance of the valve ring produced from it is higher. Another reason for this is that the film formed by the oxides on the valve seat ring develops a separating and lubricating property.

If the sintered material of the present invention is used for producing valve seats for internal combustion engines having a seat ring disposed in the seat and a valve ring disposed on the seat face of the valve, then in any case the valve ring disposed on the seat face of the valve must comprise the sintered material according to the invention. This preferred embodiment is based on the recognition that the particular heat of the valve can be best dissipated, if at least the valve ring disposed on the seat face of the valve has high thermal conductivity. Contrarily, heat dissipation from the valve would be possible to a lesser extent if the seat ring disposed in the seat had a higher thermal conductivity than the valve ring disposed on the seat face of the valve.

For producing valve seat rings, in accordance with the invention, each of the above-described features of the sintered material may be used. In a preferred embodiment, the component of metal alloy elements in the copper base material comprises from 1 to 3% by weight of cobalt.

The invention also relates to a method for producing heat- and wear-resistant molded articles, in particular valve seat rings, using a sintered material according to the present invention. In this process, the matrix powder is mixed with a lubricant, the mixture is compressed into a mold and sintered at approximately 1000° C. in a protective gas atmosphere. If in a feature of the invention a hard phase is processed, then the process comprises admixing to the metal powder as the matrix powder not only the lubricant, but also the additional high-alloy metal powder as a hard phase, compressing the mixture into a mold, and sintering it at approximately 1000° C. in a protective gas atmosphere.

The lubricant is a known aid used in compacting. It is admixed with the metal powders or metal powder mixtures to improve the compressibility, in amounts of from 0.5 to 1% by weight. Prior to the actual sintering process, the lubricant decomposes without residue at temperatures of approximately 400° C. and expelled. After the sintering, the lubricant is no longer detectable in the sintered material. The type and amount of the admixed lubricant therefore has no effect on the properties of the sintered material. Zinc stearate is for instance used as the lubricant.

With the process according to the present invention, structures can be produced in which more or less finely distributed, wear-reducing structural constituents are embedded in a highly thermally conductive matrix made of the alloy. The use of powder metallurgical processes to produce molded articles, in particular valve seat rings, affords not only the opportunity of increasing the wear resistance of the parts, but also has the advantage of particularly economical production. With powder metallurgy processing, it is possible to preform the ring blank in a most economical manner, with the blank then needing little, if any, follow-up machining. The compacting may be done by coaxial compacting technology, and if needed the molded articles may be sized after the sintering.

The use of valve seat rings according to the invention leads to the aforementioned greater dissipation of heat from the valve. As a result, the valve becomes less hot. This means that deposits that are found in the use of prior art valve seat rings are not produced in the fillet of the inlet valve made in accordance with the present invention. In the known valve seat rings, deposits are the consequence of premature, uncontrolled combustion of the gasoline-air mixture in the vicinity of the fillet of the valve plate, which is very hot because of heat buildup. The use of a valve seat ring according to the present invention avoids this kind of carbonization and the associated undesirable deposits. The temperature of the valve is in fact below the minimum temperature necessary for the carbonization to occur.

BRIEF DESCRIPTION OF THE DRAWINGS

Further characteristics and advantages of the invention will become apparent from the following description of exemplary embodiments, which do not restrict the scope of the invention, with reference to the drawing, wherein:

In the coarse two-phase sintered material of FIG. 1, wear-reducing structural constituents, i.e., a hard phase 11, are embedded and more or less finely distributed in a matrix, of a copper basic material 12. The hard phase 11 preferably has one of the above-described compositions. The proportion of the hard phase 11 amounts to a maximum of 30% by weight, while that of the copper basic material 12 amounts to at least 70% by weight. FIG. 3 shows a cylinder head 22 of a combustion engine in which there is a conduit 14. The conduit 14 has a seat 15 in a lower region. Disposed in the seat 15 is only a single valve seat ring 21, which comprises the sintered material according to the invention. A valve 18, in the open position shown, is located with its seat face 20, embodied on a valve plate 19, spaced apart from the valve seat ring 21.

FIG. 4 is a fragmentary section through the cylinder head 22 of a combustion engine. In contrast to the exemplary embodiment of FIG. 3, a seat ring 16 joined to a valve ring 17 is disposed in the seat 15. Both the seat ring 16 and the valve ring 17 comprise the sintered material according to the invention.

Figure 1:
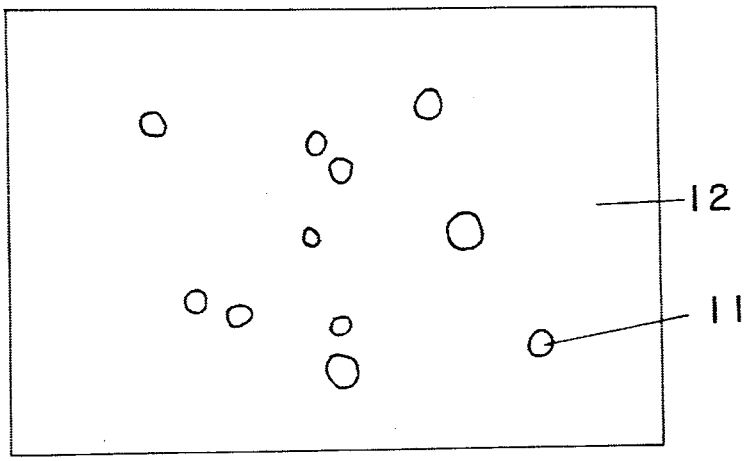
FIG. 1 is a schematic structural diagram of a coarse two-phase sintered material produced by powder metallurgy according to the present invention.
Figure 2:
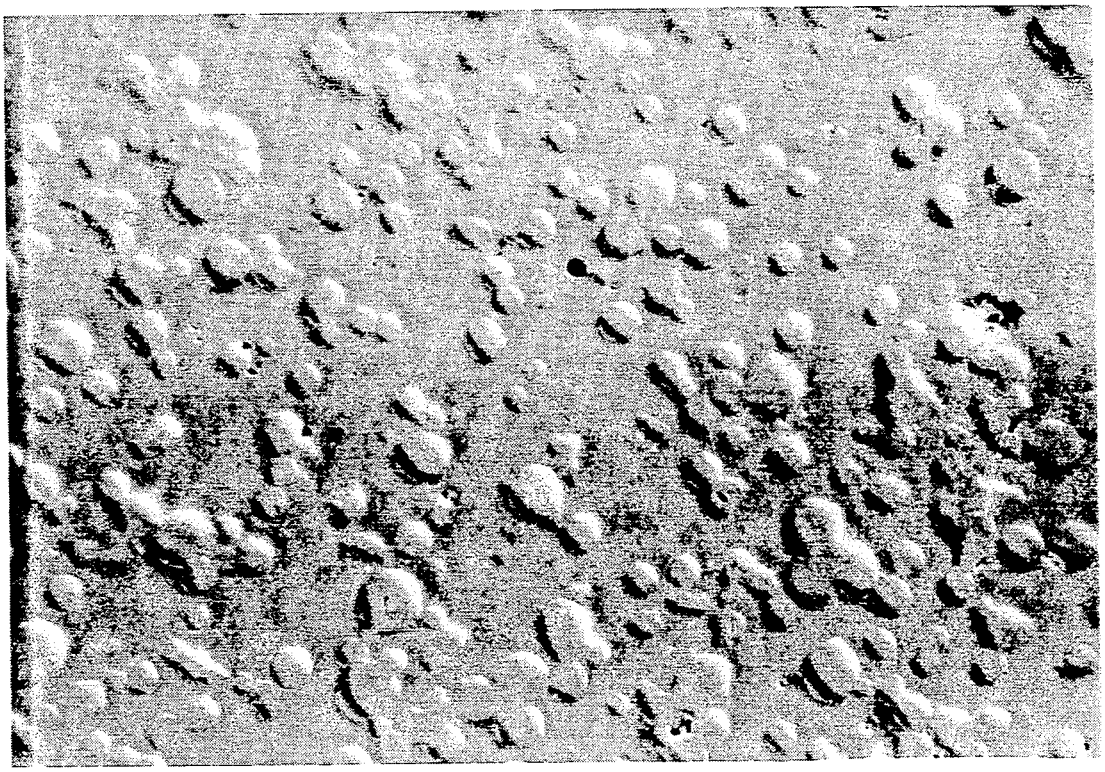
FIG. 2 is a photograph of a polished section of the structure of the sintered material of FIG. 1, enlarged 125 times.
Figure 3:
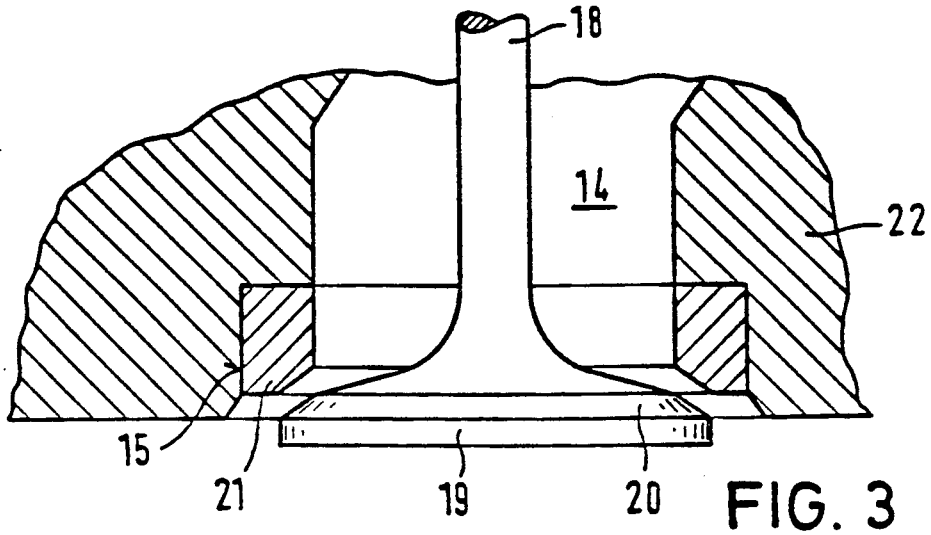
FIG. 3 is a fragmentary section of a valve seat having a valve seat ring, viewed through a cylinder head.
Figure 4:
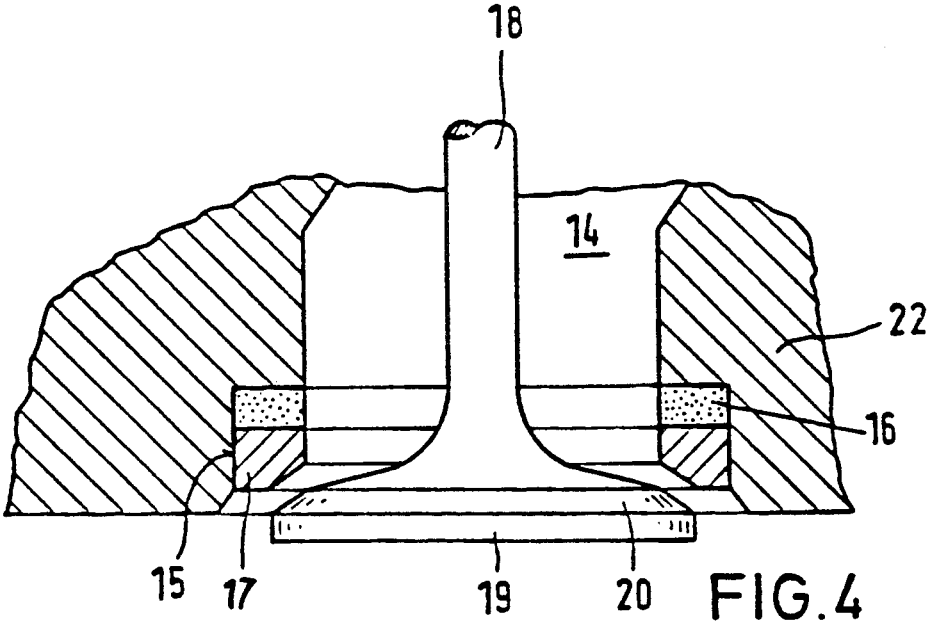
FIG. 4 is a fragmentary section of a valve seat according to the present invention having a seat ring and a valve ring, viewed through a cylinder head.

The properties of the sintered material according to the invention and its use preferably for valve seat rings make heavy-duty use possible. This may be the case for instance for inlet valves in diesel engines with turbocharging, or outlet valves of Otto engines when unleaded fuel is used. Depending on the embodiment of the invention, the necessary service life of the valves is attainable without it being necessary to especially clad the valve plates in the seat face. Wear, at the valve seat ring and at the associated valve disc is even reduced.

What is claimed is:

1. A sintered material resistant to heat and mechanical strain for the production of molded articles, consisting essentially of a hard phase and a matrix metal powder, said matrix metal powder consisting of approximately 70 to 100% by weight of a copper component and approximately 0 to 30% by weight of an alloy component selected from the group consisting of cobalt, chromium, iron, manganese, nickel, tungsten, carbon and mixtures thereof, and said hard phase admixed with said matrix metal powder consisting of a second metal powder component selected from the group consisting of cobalt, chromium, iron, manganese, nickel, tungsten, and mixtures selected from the group consisting of cobalt, chromium, iron, manganese, nickel, tungsten and carbon, said second metal powder component present in an amount up to approximately 30% by weight, measured with respect to the sum of the weight of the matrix metal powder and the second metal powder component.

2. The sintered material as defined by claim 1, wherein the copper component is from 95 to 99% by weight and the alloy component is from 5 to 1% by weight.

3. The sintered material as defined by claim 1, wherein the alloy component has from 1 to 3% by weight of cobalt.

4. The sintered material as defined by claim 1, the metal powder maximum particle size is approximately 150 μm and mean particle size is approximately 45 to 60 μm.

5. The sintered material as defined by claim 1, wherein the hard phase, in percent by weight, comprises:

24 to 28% chromium,
21 to 25% nickel,
10 to 14% tungsten,
1.5 to 2.0% carbon, and
the remainder being cobalt.

6. The sintered material as defined by claim 1, wherein the hard phase, in percent by weight, comprises:

28 to 32% chromium,
5 to 10% tungsten,
0.3 to 2.5% carbon, and
the remainder being cobalt.

7. The sintered material as defined by claim 5 wherein the matrix metal powder is a pure, unalloyed copper powder.

8. The sintered material as defined by claim 1, wherein the hard phase, in percent by weight, comprises:

23 to 27% chromium,
8 to 12% nickel,
8 to 12% manganese,
0.4 to 0.6% carbon, and the remainder being iron.

9. In a wear-resistant molded articles for use in a hot gas environment, the articles being formed of a sintered powder, the improvement comprising the sintered material consisting essentially of a hard phase and a matrix metal powder, said matrix metal powder consisting of approximately 70 to 100% by weight of a copper component and approximately 0 to 30% by weight of an alloy component selected from the group consisting of cobalt, chromium, iron, manganese, nickel, tungsten, carbon and mixtures thereof, and said hard phase admixed with said metal matrix powder consisting of a second metal powder component selected from the group consisting of cobalt, chromium, iron, manganese, nickel, tungsten, and mixtures selected from the group consisting of cobalt, chromium, iron, manganese, nickel, tungsten and carbon, second metal power component present in an amount up to approximately 30% by weight, measured with respect to the sum of the weight of the matrix metal powder and the second metal powder component.

10. The wear-resistant article as defined by claim 9 wherein the article is a seal.

11. The wear-resistant article as defined by claim 9 wherein the article is a guide.

12. The wear-resistant article as defined by claim 9 wherein the article is a bearing.

13. In a valve seat for internal combustion engines, the valve seat having at least one ring to be disposed in the seat, the ring being formed of a sintered material, the improvement comprising the sintered material consisting essentially of a hard phase and a matrix metal powder, said matrix metal powder consisting of approximately 70 to 100% by weight of a copper component and approximately 0 to 30% by weight of an alloy component selected from the group consisting of cobalt, chromium, iron, manganese, nickel, tungsten, carbon and mixtures thereof, and said hard phase admixed with said matrix metal powder consisting of a second metal powder component selected from the group consisting of cobalt, chromium, iron, manganese, nickel, tungsten, and mixtures selected from the group consisting of cobalt, chromium, iron, manganese, nickel, tungsten and carbon, said second metal powder component present in an amount up to approximately 30% by weight, measured with respect to the sum of the weight of the matrix metal powder and the second metal powder component.

14. In a valve seat for internal combustion engines as defined by claim 13, the valve seat having a seat ring to be disposed in the seat and a valve ring to be disposed on the seat face of the valve, the valve ring being formed of a sintered material, the improvement comprising the sintered material consisting essentially of a hard phase and a matrix metal powder, said matrix metal powder consisting of approximately 70 to 100% by weight of a copper component and approximately 0 to 30% by weight of an alloy component selected from the group consisting of cobalt, chromium, iron, manganese, nickel, tungsten, carbon and mixtures thereof, and said hard phase admixed with said matrix metal powder consisting of a second metal powder component selected from the group consisting of cobalt, chromium, iron, manganese, nickel, tungsten, and mixtures selected from the group consisting of cobalt, chromium, iron, manganese, nickel, tungsten and carbon, said second metal powder component present in an amount up to approximately 30% by weight, measured with respect to the sum of the weight of the matrix metal powder and the second metal powder component.

15. A method for producing heat-resistant and wear-resistant molded articles, in particular valve seat rings, using a matrix metal powder and a second metal powder, wherein said matrix metal powder consists of approximately 70 to 100% by weight of a copper component and approximately 0 to 30% by weight of an alloy component selected from the group consisting of cobalt, chromium, iron, manganese, nickel, tungsten, carbon and mixtures thereof, and wherein said second metal powder component is selected from the group consisting of cobalt, chromium, iron, manganese, nickel, and tungsten, and mixtures selected from the group consisting of cobalt, chromium, iron, manganese, nickel, tungsten and carbon, comprising:

mixing the matrix metal powder and second metal powder with a lubricant, compacting the mixture into a molded article, and sintering the metal powder at approximately 1,000° C. in a protective gas atmosphere, to form the molded article.

16. The method as defined by claim 15, wherein the compacting is effected by coaxial compacting technology.

17. The method as defined by claim 15, further comprising sizing the molded articles after sintering.

18. The sintered material as defined by claim 6, wherein the matrix metal powder is a pure, unalloyed copper powder.

19. The method as defined by claim 16, wherein the compacting is effected by coaxial compacting technology.

20. A sintered material resistant to heat and mechanical strain for the production of molded articles, consisting of a matrix metal powder of approximately 70 to 99% by weight of a copper component and approximately 1 to 30% by weight of an alloy component selected from the group consisting of chromium, iron, manganese, nickel, tungsten, and cobalt.

21. The sintered material as defined in claim 20, wherein the copper component is from 95 to 99% by weight and the alloy component is from 5 to 1% by weight.

22. The sintered material as defined by claim 20, wherein the metal powder maximum particle size is approximately 150μm and the mean particle size is approximately 45 to 60μm.

23. The sintered material as defined in claim 20, wherein the alloy component has 1 to 3% by weight of cobalt.

24. A wear-resistant molded article for use in a hot gas environment, formed of a sintered material consisting of a matrix metal powder of approximately 70 to 99% by weight of a copper component and approximately 1 to 30% by weight of an alloy component selected from the group consisting of chromium, iron, manganese, nickel, tungsten, and cobalt.

25. The wear-resistant article defined by claim 24 wherein the article is a seal.

26. The wear-resistant article as defined by claim 24 wherein the article is a guide.

27. The wear-resistant article as defined by claim 24 wherein the article is a bearing.

28. A valve seat for an internal combustion engine having at least one ring disposed in said seat, the ring formed of a sintered material consisting of a matrix metal powder of approximately 70 to 99% by weight of a copper component and approximately 1 to 30% by weight of an alloy component selected from the group consisting of, chromium, iron, manganese, nickel, tungsten, and cobalt, the valve seat being self-lubricating upon exposure to combustion gases.

29. A valve seat as defined in claim 28, including a valve ring disposed on a seat face of the valve, said valve ring formed of a sintered material consisting of a matrix metal powder of approximately 70 to 99% by weight of a copper component and approximately 1 to 30% by weight of an alloy component selected from the group consisting of, chromium, iron, manganese, nickel, tungsten, and cobalt.

30. A method for producing molded articles using a matrix metal powder of approximately 70 to 99% by weight of a copper component and approximately 1 to 30% by weight of an alloy component selected from the group consisting of chromium, iron, manganese, nickel, tungsten, and cobalt, comprising:

mixing the matrix metal powder and alloy component with a lubricant, compacting the mixture into a molded article, and sintering the metal powder at approximately 1,000° C. in a protective gas atmosphere to form the molded article.

31. The method as defined by claim 30, wherein the compacting is effected by coaxial compacting technology.

32. The method as defined by claim 30, further comprising sizing the molded articles after sintering.

* * * * *